US009592535B2

(12) United States Patent
Ralph

(10) Patent No.: US 9,592,535 B2
(45) Date of Patent: Mar. 14, 2017

(54) SCREEN FRAME

(71) Applicant: M-I Drilling Fluids U.K. Ltd., Aberdeenshire (GB)

(72) Inventor: Andrew John Ralph, East Lothian (GB)

(73) Assignee: M-I Drilling Fluids U.K. Ltd., Aberdeenshire (GB)

( * ) Notice: Subject to any disclaimer, the term of this patent is extended or adjusted under 35 U.S.C. 154(b) by 0 days.

(21) Appl. No.: 14/379,421

(22) PCT Filed: Feb. 18, 2013

(86) PCT No.: PCT/GB2013/050386
§ 371 (c)(1),
(2) Date: Aug. 18, 2014

(87) PCT Pub. No.: WO2013/121227
PCT Pub. Date: Aug. 22, 2013

(65) Prior Publication Data

US 2015/0021241 A1 Jan. 22, 2015

(30) Foreign Application Priority Data

Feb. 16, 2012 (GB) ..... 1202675.3
Nov. 1, 2012 (GB) ..... 1219679.6

(51) Int. Cl.
*B07B 1/49* (2006.01)
*B07B 1/46* (2006.01)
*B07B 1/28* (2006.01)

(52) U.S. Cl.
CPC ..... *B07B 1/46* (2013.01); *B07B 1/28* (2013.01); *B07B 1/4618* (2013.01); *B07B 1/4663* (2013.01); *B07B 1/4681* (2013.01)

(58) Field of Classification Search
CPC ..... B07B 1/46; B07B 1/4672; B07B 1/4681
See application file for complete search history.

(56) References Cited

U.S. PATENT DOCUMENTS 2,321,675 A 6/1943 Hauge
8,596,464 B2 * 12/2013 Robertson ..... B07B 1/4672 209/392

(Continued)

FOREIGN PATENT DOCUMENTS

| | | |
|---|---|---|
| DE | 2160875 | 6/1973 |
| GB | 2461725 B | 6/2012 |
| GB | 2461727 B | 6/2012 |

OTHER PUBLICATIONS

International Search Report and Written Opinion of PCT Application Serial No. PCT/GB2013/050386 dated May 15, 2013 (9 pages).

*Primary Examiner* — Howard Sanders
(74) *Attorney, Agent, or Firm* — David J. Smith

(57) ABSTRACT

A screen support frame comprising, a perimeter disposed in a horizontal plane, defining a vertical direction normal to said plane, said perimeter reinforced by an arrangement of reinforcing wires, said arrangement comprising a first array of substantially parallel structural wires extending between opposing regions of the perimeter in a first horizontal plane, a second array of substantially parallel structural wires extending between opposing regions of the perimeter in a second horizontal plane, said first and second arrays of structural wires being aligned at an angle to each other and in contact with each other thus forming a plurality of contact points between structural wires of the first and second array respectively, the arrangement further comprising at least one additional structural wire, said additional structural wire extending between opposing regions of the perimeter and being positioned parallel to, and substantially vertically spaced from, a wire in the first array of structural wires, and in contact with wires of the second array.

16 Claims, 6 Drawing Sheets

(56) References Cited

U.S. PATENT DOCUMENTS

| | | | | |
|---|---|---|---|---|
| 2002/0113043 | A1* | 8/2002 | Cook et al. | 219/85.22 |
| 2011/0049018 | A1 | 3/2011 | Beukes | |

* cited by examiner

SCREEN FRAME

FIELD OF THE DISCLOSURE

Embodiments disclosed herein relate generally to a screen support frame comprising a perimeter, particularly but not exclusively for forming part of a screen e.g. for use in a shaker to separate solids from a liquid/solid mixture.

BACKGROUND

Efficiently separating solids from liquids is a widespread technical problem. One of the most practical and robust methods of achieving this remains the use of a sieve, or screen, to sift the solids from the mixture of liquid and solid.

When drilling for oil and/or gas, synthetic drilling fluids, or muds, are used. As these muds are relatively expensive to manufacture, once used they are typically recovered in a process including sifting rock, shale and other debris from the mud. This involves the use of a so-called shaker which has fitted, one or more sifting screens, made up of a screen frame with one or more sheets of woven wire mesh, or screen, stretched over and secured to it. In use, the shaker vibrates the sifting screen or screens, to aid the sifting process.

To be able to withstand the rigours of this sifting process, sifting screens must have a certain rigidity and be very hard-wearing. This has resulted in a design of sifting screens having a screen frame which has a plurality of reinforcing "ribs". A typical design of a screen frame is rectangular comprising an outer rectangular perimeter with each side connected to its opposing side by a plurality of ribs. Such a design results in a plurality of rectangular openings. Typically the screen is attached not only to the rectangular perimeter but also to the ribs, to provide better adhesion of the screen to the frame and prolonging its lifetime.

In view of the fact that sifting screens are man-handled into position, such screen frames have for some time been made from plastics material to reduce weight. A typical design of plastic screen frame is reinforced by including a metal wire structure, embedded within the plastics rectangular perimeter and rib arrangement.

However, it has been found that such wires can lack the required stiffness, especially when extending between longer distances for large screen frames, and sag under gravity reducing their effectiveness as reinforcing structures.

It has been proposed, in e.g. GB 2461725, to use strengthening ribs between the upper and lower arrays of wires to improve the overall rigidity of the screen cage and frame. However using such ribs requires modification of the manufacturing process and associated tooling and increases material costs and complexity.

Thus further ways to improve rigidity of such screen frames without introducing significant weight to the screen frame would be highly desirable.

BRIEF DESCRIPTION OF THE DRAWINGS

The disclosure will now be described, by way of example, and with reference to the accompanying drawings in which.

DETAILED DESCRIPTION

Figure 1:
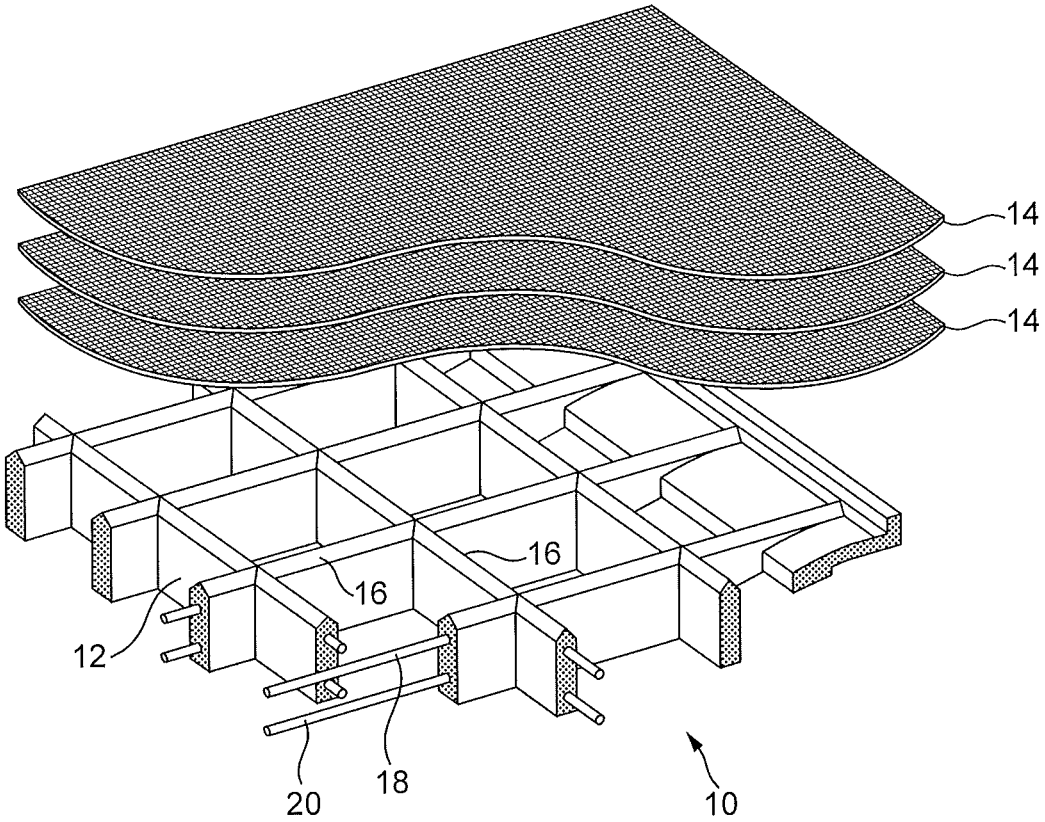
FIG. 1 is an exploded perspective view of a part of a known screen.

FIG. 1 shows a known screen (10) comprising a frame (12) to which are attached three layers of woven wire mesh (14), shown in exploded view for ease of reference. The frame (12) comprises an orthogonal array of cells formed from intersecting plastics ribs (16) moulded over upper and lower arrays of structural wires (18), (20).

Figure 2:
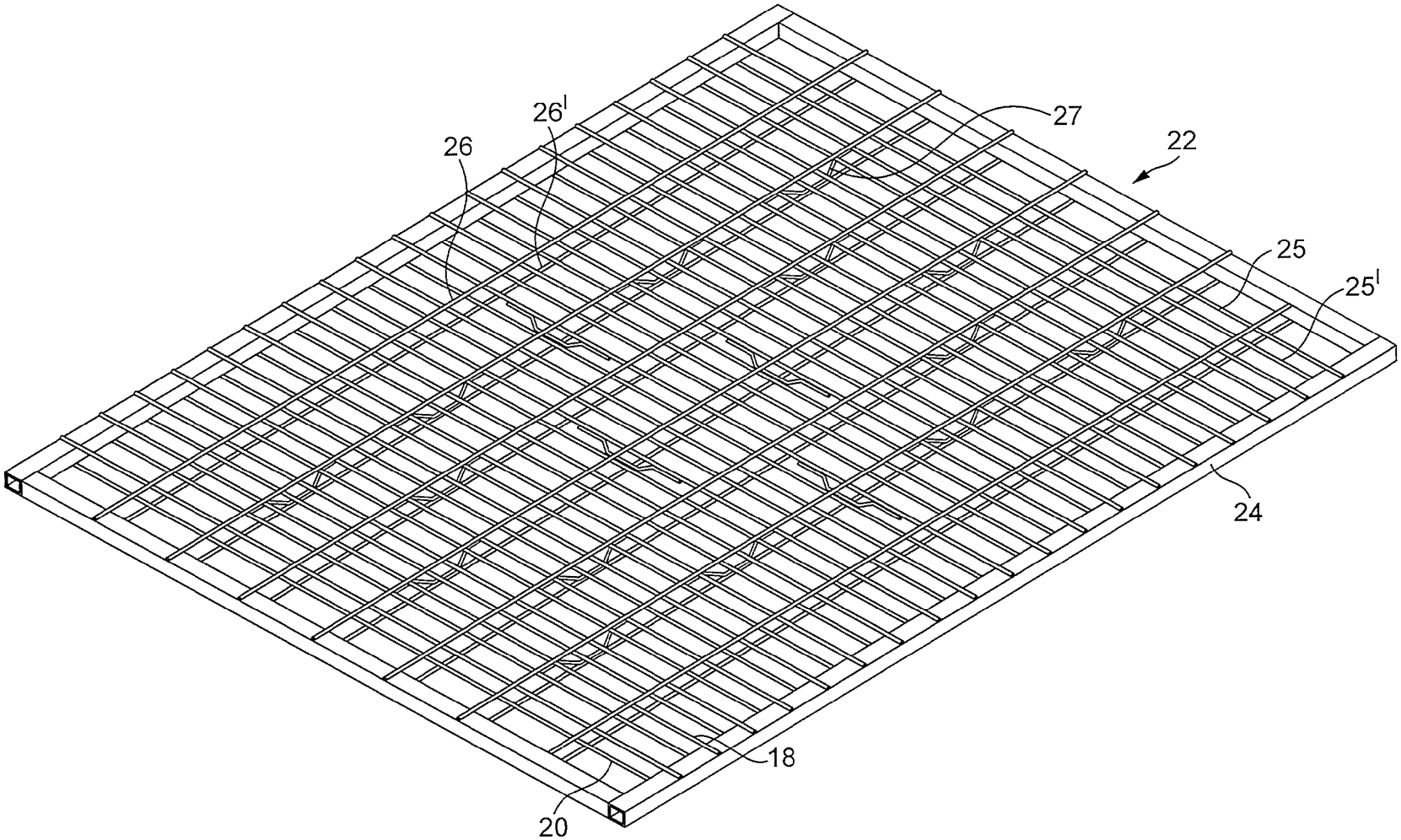
FIG. 2 is a perspective view of a screen support frame forming part of such a screen.

FIG. 2 shows a wire structure or subframe (22) which will be encased in plastics material, such as thermoplastics material, to form a screen frame as in FIG. 1. Structure (22) comprises a rectangular perimeter frame (24) from opposing sides of which run a plurality of steel wires (25), (25'), (26), (26') welded together to form upper array (18) and lower array (20) of orthogonally intersecting wires, the two arrays being spaced from each other. Array (18) is formed from upper orthogonally intersecting wires (25), (26) and array (20) formed from lower orthogonally intersecting wires (25'), (26'). Where desired, and is known in the art, spacers (27) are welded between selected wires of the upper and lower arrays to maintain a desired separation distance.

The screen frame typically has a length of between 60 to 1300 cm and a width of between 60 to 100 cm. During moulding to create the plastics ribs shown in FIG. 1, wires (25), (25'), (26), (26') experience a reduction in stiffness due to the length over which they are unsupported. This leads to the wires flexing and contacting the mould tool, causing the wires to break through the plastics encapsulation once moulded. This is particularly so for those wires (26), (26') running the length of the screen frame which are unsupported over a greater distance.

Figure 3:
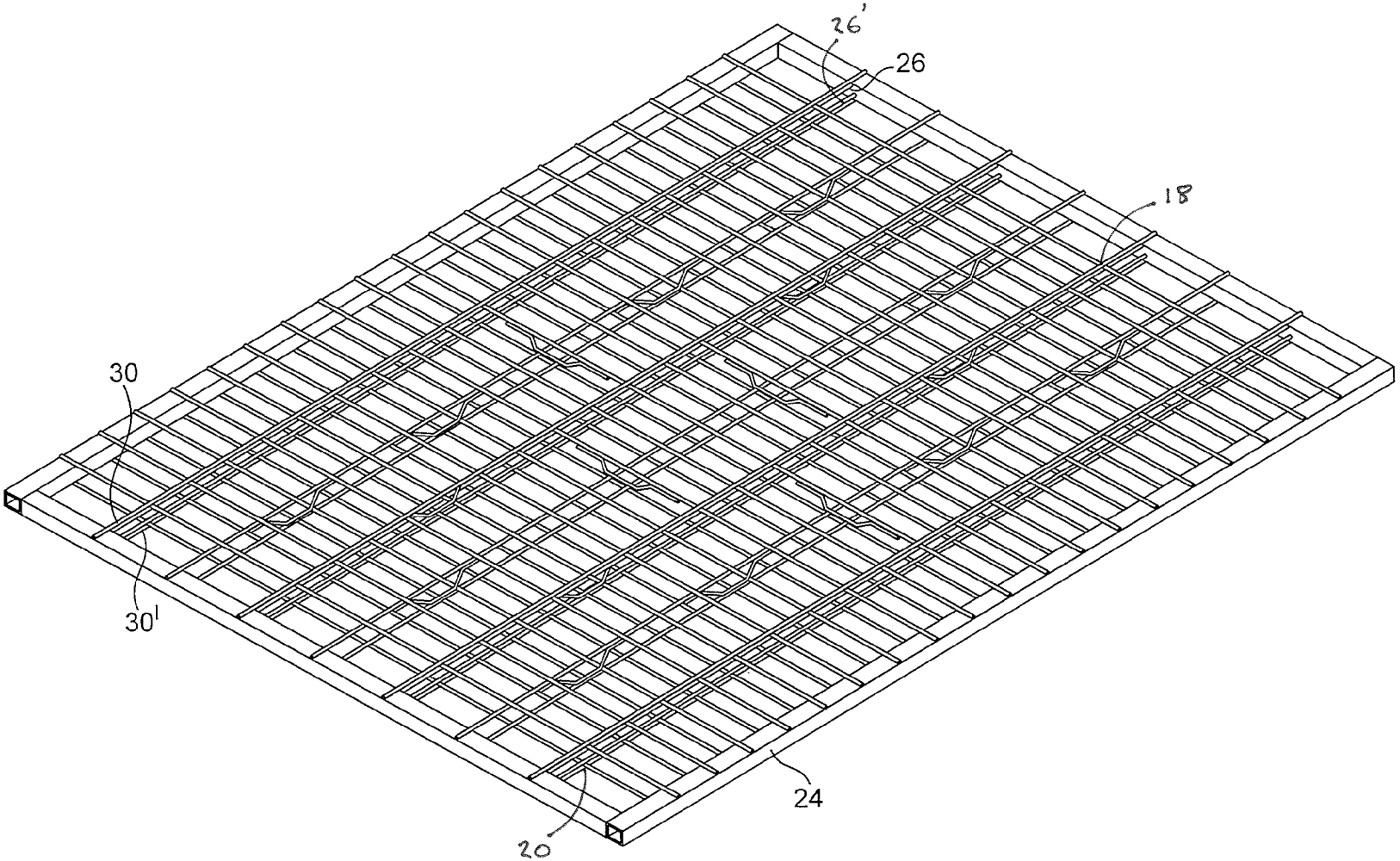
FIG. 3 is a perspective view of a screen support frame according to the disclosure.
Figure 4:
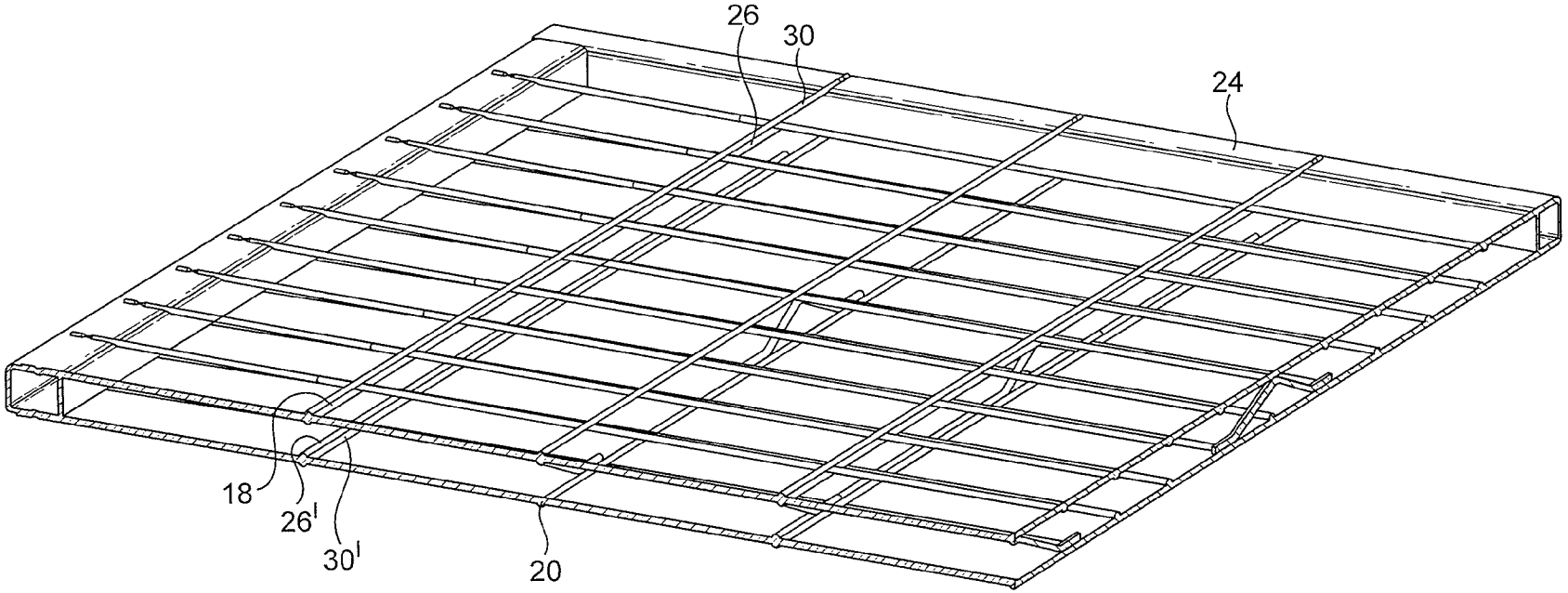
FIG. 4 is a detailed perspective view of part of the screen support frame of FIG. 3.
Figure 5:
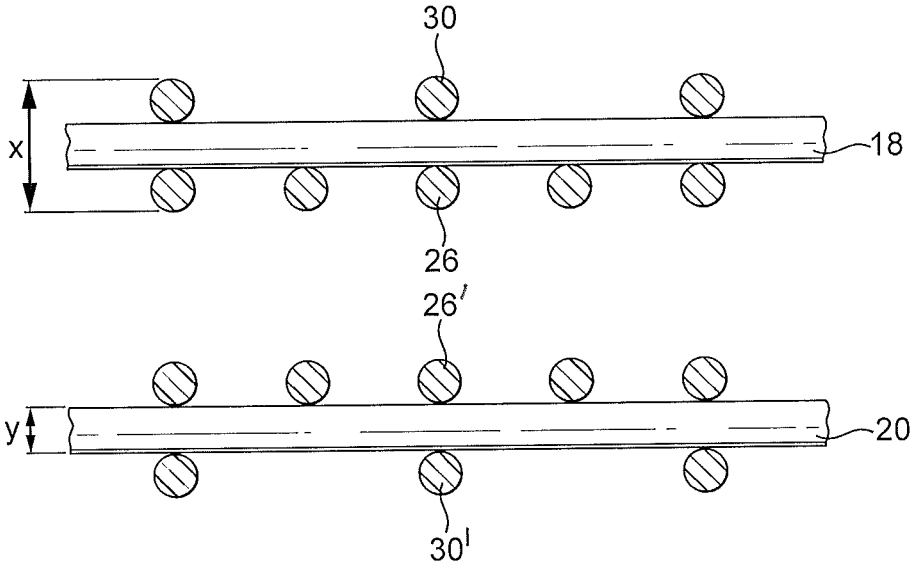
FIG. 5 is an enlarged partial cross-section of the frame structure shown in FIGS. 3 and 4.

In accordance with the disclosure and as shown in FIGS. 3, 4 and 5, a screen frame having a rectangular perimeter (24) is provided. The perimeter is reinforced by a first upper arrangement (18) of reinforcing wires and a lower second arrangement (20) of reinforcing wires.

As can be seen in detail in FIG. 5, structural wires (26) provide the first array of structural wires for the upper arrangement (18) and structural wires (26') provide the first array of structural wires for the second lower arrangement (20). Also shown in FIG. 5 is a wire from the second array, which is orthogonal to the wires of the first array (26), (26'). As can be seen, the wires of the first and second arrays in both the first (18) and second (20) arrangements, are in contact.

Also provided are additional structural wires (30) for the upper arrangement (18) and additional structural wires (30') for the lower arrangement (20). As can be seen the additional structural wires (30), (30') are parallel and vertically spaced from a wire in the first array (26) in the first and second arrangement respectively.

It will also be noted that only some of the wires (26) in the upper arrangement (18) and lower arrangement (20) have a corresponding additional structural wire (30), (30').

The secondary wires (30), (30') stiffen alternate pre-existing longitudinal wires (26), (26') which helps prevent the pre-existing wires flexing on moulding and improves the overall stiffness of the cage structure (22).

As shown in FIG. 3, these supporting secondary wires run along the length of the frame co-linear and proximal to selected wires (26), (26') although if desired they can be used to reinforce wires running along the width of the frame.

If desired, additional structural wires can be provided for all wires (26), (26') running the length of the frame but generally it will be sufficient to provide secondary wires for every other wire running the length of the frame, as shown.

By having two proximal wires, the wire pairs (30), (26) and (30'), (26') effectively provide a beam structure that is equivalent to their total diameter plus the diameter of the wire from the second array between them. Thus as shown in FIG. 4, if wires (30), (26) both have a cross-sectional diameter of 2.5 mm with a gap of 1.5 mm between them, then they act as a beam of 6.5 mm.

By pressing the reinforced cage of FIG. 3 and the unreinforced cage of FIG. 2 with the same amount of force, a significant increase of stiffness of the reinforced cage was observed. To quantify the amount of improvement, finite element analysis was undertaken in ANSYS Workbench modelling software (available from ANSYS, Inc., of Canonsburg, Pa., USA) to compare the stress and deflection in the respective frames. For a common load, a traditional cage as shown in FIG. 2 exhibited a maximum deflection of 0.94 mm, with a reinforced cage as shown in FIG. 3 exhibiting a maximum deflection of 0.53 mm. Thus when the respective structures were loaded and constrained in an identical way, the reinforced structure deflected 43% less. The present disclosure provides a substantial improvement on the stiffness encountered with single wires as shown in the prior art frame of FIG. 2, with this achieved for less material cost than using a rigid bar as the wire is cheaper and with less complexity as the secondary wires can be incorporated readily into the existing manufacturing techniques.

Figure 6:
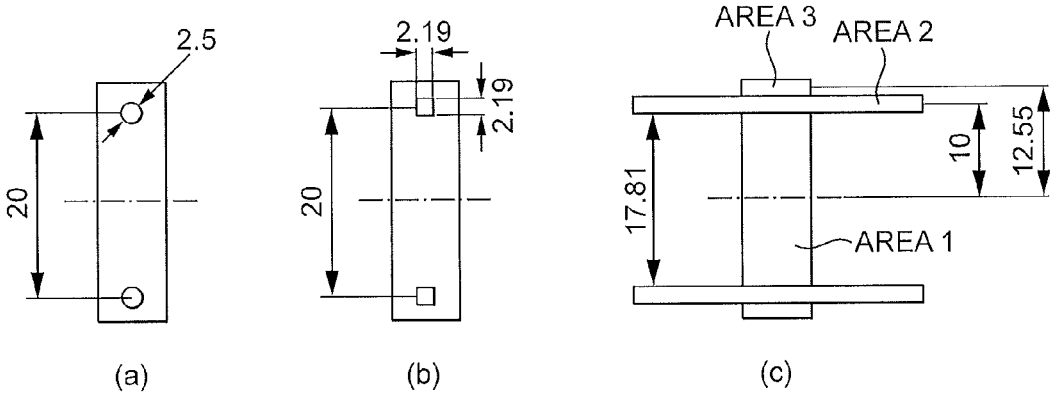
FIG. 6 illustrates mathematical sections used to model the stiffness of the frame of FIG. 2.

Theoretical modelling illustrates the improvements achieved using the disclosure. For a frame as shown in FIG. 2 when moulded into a screen, calculation of the second moment of area can give an indication of the stiffness of the structure. FIG. 6 shows diagrammatically how the second moment of area for the frame of FIG. 2 can be viewed. FIG. 6(*a*) represents the frame (12) as polypropylene with two strengthening steel wires equivalent to the wires in the upper and lower arrays (18), (20), those wires (25) having a circular cross-section of 2.5 mm diameter. To simplify calculation of the second moment of area, the round wires can be converted to a square section of an equivalent second moment, see FIG. 6(*b*), where the equivalent square wire dimension is 2.19×2.19 mm.

Keeping the height constant, the width of the steel section when multiplied by the modular ratio gives the equivalent width of the square steel wire as polypropylene.

Young's modulus (mild steel)=$E_s$=210 GPa

Young's modulus (polypropylene) $E_{pp}$=0.896 GPa

Equivalent width=$2.19\times(E_s/E_{pp})$=513 mm

This is shown in FIG. 6(*c*) where (c) represents an equivalent transformed polypropylene section having the same properties as the composite section of 6(*a*).

The second moment for the transformed section=$I_{xx\ TOTAL}=I_{AREA1}+(I_{AREA2})+(I_{AREA3})$ where:

$I_{AREA1}$ is $$Ixx = \frac{bd^3}{12}$$

and $I_{AREA1}$, $I_{AREA3}$ are $$Ixx = 2\left(\frac{bd^3}{12} + Ah^2\right)$$

b=width, d=height, A=area, h=distance from neutral axis to centroid.

This gives second moments as shown below:

| Analysis | Result |
|---|---|
| $I_{AREA1}$ | 14634 |
| $I_{AREA2}$ | 225592 |
| $I_{AREA3}$ | 7352 |
| $I_{TOTAL}$ (mm$^4$) | 236710 |

Figure 7:
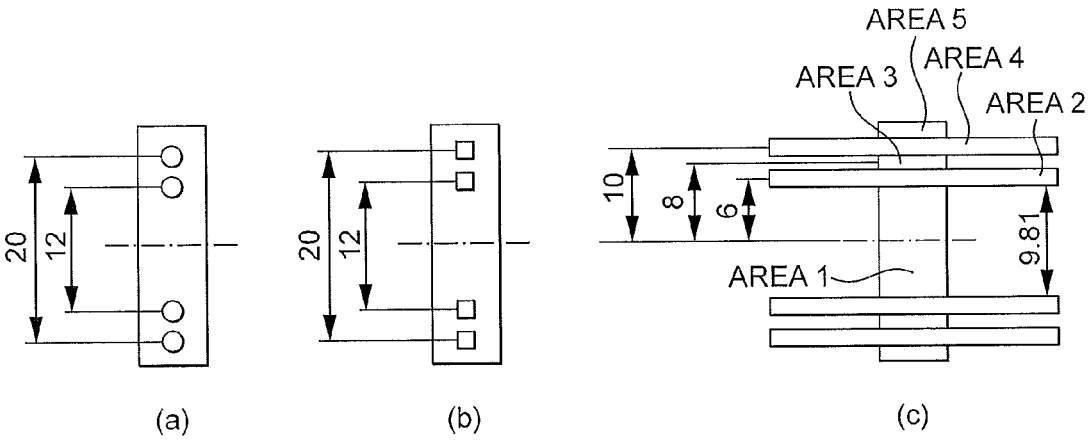
FIG. 7 illustrates mathematical sections used to model the stiffness of the frame of FIG. 3.

Using the same principle, the second moment of area can be found for the reinforced structure of FIG. 3. First the model is transformed into an equivalent polypropylene section, see FIG. 7 where 7(*a*) shows the model with paired steel wires and 7(*c*) shows the polypropylene equivalent.

The second moment of area equals:

$$I_{TOTAL}=I_{AREA1}+(I_{AREA2})+(I_{AREA3})+(I_{AREA4})+(I_{AREA5})$$

where $I_{AREA4}$ and $I_{AREA5}$ are calculated as for $I_{AREA2}$ and $I_{AREA3}$.

This gives a total second moment of area as below:

| Reinforced Structure Analysis | Result |
|---|---|
| $I_{AREA1}$ | 629 |
| $I_{AREA2}$ | 81788 |
| $I_{AREA3}$ | 1861 |
| $I_{AREA4}$ | 225592 |
| $I_{AREA5}$ | 7252 |
| $I_{TOTAL}$ (mm$^4$) | 317222 |

The higher I, the stiffer a beam is and the more load that is required to generate deflections. The reinforced structure exhibits a higher I and so is better than the frame of FIG. 2.

From finite element analysis using ANSYS Workbench, it was observed that a known deflection (0.2254 mm) occurred at the centre of a RM3 industrial the screen when a 60 m/s$^2$ acceleration was applied to the screen, using the deflection equation $$\text{Deflection (mm)} = \delta = \frac{F1^3}{48EI}$$

Rearranging the above equation, it is possible to calculate what force is required to generate a known deflection for the different second moments of areas calculated above.

$$\text{Force}(N) = F = \frac{\delta EI48}{1^3}$$

Working with these values and rearranging the deflection equation to calculate force, it was found that the reinforced frame was 1.3 times stiffer than the frame of FIG. 2 (2.37N as compared to 1.77N).

In accordance with one aspect of the present disclosure, there is provided a screen support frame comprising, a perimeter disposed in a horizontal plane, defining a vertical direction normal to said plane, said perimeter reinforced by an arrangement of reinforcing wires, said arrangement comprising a first array of substantially parallel structural wires extending between opposing regions of the perimeter in a first horizontal plane, a second array of substantially parallel structural wires extending between opposing regions of the perimeter in a second horizontal plane, said first and second arrays of structural wires being aligned at an angle to each other and in contact with each other thus forming a plurality of contact points between structural wires of the first and second array respectively, the arrangement further comprising at least one additional structural wire, said additional structural wire extending between opposing regions of the perimeter and being positioned parallel to, and substantially vertically spaced from, a wire in the first array of structural wires, and in contact with wires of the second array.

The apparatus of the present disclosure thus provides an arrangement of two parallel wires above and below and in contact with the wires in the second array, said arrangement providing a particularly stiff contact and much greater stiffness than if the at least one additional structural wire were not present.

Typically the additional at least one structural wire is spaced from a wire in the first array of structural wires by a distance between 1.0 and 2.5 mm.

The wires forming the first array are generally evenly spaced apart, i.e. that the distance between adjacent wires in the array is substantially fixed. Likewise the wires forming the second array are also generally evenly spaced apart.

Typically the perimeter is rectangular comprising two parallel short sides and two parallel long sides. In this case it is preferable that the first array of substantially parallel structural wires extends between the short sides of the perimeter and the second array of substantially parallel wires extends between the long sides of the perimeter. This ensures that the wires extending for the longest distance are reinforced by a parallel at least one additional structural wire. In this case, the first and second arrays of structural wires are aligned at right angles to each other.

In one embodiment, each of the wires in the first array is reinforced by a respective additional structural wire. However, it has been found that the majority of the improvements in overall stiffness can be achieved when not all of the wires in the first array are reinforced by an additional structural wire.

Preferably the additional structural wires have a circular cross-section, which may be an identical circular cross-section to the wires of the first and/ore second array. Typically, the cross-sectional diameter of the additional structural wires may range from 10 mm to 1 mm and more preferably 5 mm to 2 mm.

Thus, it will be understood that the first array of structural wires, the second array of structural wires and the additional structural wires, although being in different but parallel planes, are all in contact, and thus form an arrangement whereby the contacts provide the increased stiffness.

In a further preferred embodiment, in addition to the arrangement disclosed, there is provided a second arrangement of such wires, said second arrangement lying in a plane parallel to but spaced apart from, the first arrangement. This duplication of the arrangement of the present disclosure provides a further increase in stiffness.

As discussed above, the screen frame according to the present disclosure is intended to have woven wire mesh attached to the perimeter, which woven wire mesh carries out the screening function.

In general, the screen support frame the wires of both the first and second arrays are encased in plastic material, thereby forming respective arrays of plastic wire-reinforced ribs extending between the perimeter. Such ribs preferably provide an upper surface so that the woven wire mesh can attach, not only onto the perimeter, but also to the top surface of the plastic ribs.

In another aspect, the disclosure relates to a method of improving the stiffness of a screen support frame, said support frame comprising a perimeter disposed in a horizontal plane, defining a vertical direction normal to said plane, a first array of substantially parallel structural wires extending between opposing regions of the perimeter in a first horizontal plane, a second array of substantially parallel structural wires extending between opposing regions of the perimeter in a second horizontal plane, said first and second arrays of structural wires being aligned at an angle to each other and in contact with each other thus forming a plurality of contact points between structural wires of the first and second array respectively, the improvement in stiffness being provided by providing at least one additional structural wire, said additional structural wire extending between opposing regions of the perimeter and being positioned parallel to, and substantially vertically spaced from, a wire in the first array of structural wires, and in contact with wires of the second array, thereby providing an arrangement of two parallel wires on either side and in contact with the wires in the second array, said arrangement providing an increased stiffness to the screen support frame.

The invention claimed is:

1. A screen support frame comprising, a perimeter disposed in a horizontal plane, defining a vertical direction normal to said plane, said perimeter reinforced by a first arrangement comprising a first array of substantially parallel first structural wires extending between opposing regions of the perimeter in a first horizontal plane, a second array of substantially parallel second structural wires extending between opposing regions of the perimeter in a second horizontal plane, said first array of first structural wires and second array of second structural wires being aligned at an angle with respect to each other and in contact with each other thus forming a plurality of contact points between the first structural wires of the first array and the second structural wires of the second array, the arrangement further comprising at least one additional structural wire, said additional structural wire extending between opposing regions of the perimeter and being positioned parallel to, and substantially vertically spaced from, a first structural wire in the first array of first structural wires, and in contact with one or more structural wires in the second array of second structural wires such that portions of the one or more second structural wires in the second array of second structural wires are positioned between, and in contact with, the at least one additional structural wire and the first structural wire in the first array of first structural wires.

2. The screen support frame according to claim 1, wherein the at least one additional structural wire is spaced from the first structural wire in the first array of first structural wires by a distance of between 0.5 and 2.5 mm.

3. The screen support frame according to claim 1, wherein the perimeter is rectangular comprising two parallel short sides and two parallel long sides.

4. The screen support frame according to claim 3, wherein the first array of substantially parallel first structural wires extends between the short sides of the perimeter and the second array of substantially parallel second structural wires extends between the long sides of the perimeter.

5. The screen support frame according to claim 1, wherein the at least one additional structural wire has a circular cross-section.

6. The screen support frame according to claim 5, wherein the cross-sectional diameter of the at least one additional structural wire ranges from 10 mm to 1 mm.

7. The screen support frame according to claim 1, further comprising a second arrangement of said reinforcing wires, said second arrangement lying in a plane parallel to but spaced apart from the first arrangement.

8. The screen support frame according to claim 7, said second arrangement comprising a first array of substantially parallel structural wires extending between opposing regions of the perimeter in a third horizontal plane, a second array of substantially parallel structural wires extending between opposing regions of the perimeter in a fourth horizontal plane, said first and second arrays of the second arrangement being aligned at an angle to each other and in contact with each other thus forming a plurality of contact points between structural wires of the first and second arrays of the second arrangement, the second arrangement further comprising at least one additional structural wire, said at least one additional structural wire being positioned parallel and co-linear to, and substantially vertically spaced from, a wire in the first array of the second arrangement, and in contact with wires in the second array of the second arrangement.

9. The screen support frame according to claim 1, wherein the structural wires of both the first and second arrays are encased in plastic material, thereby forming respective arrays of plastic wire-reinforced ribs extending between the perimeter.

10. The screen support frame according to claim 1, further comprising a woven wire mesh screen attached to the perimeter.

11. The screen support frame according to claim 1, said at least one additional structural wire extends between the length of the horizontal plane of the perimeter.

12. The screen support frame according to claim 1, said at least one additional structural wire extends between the width of the horizontal plane of the perimeter.

13. The screen support frame according to claim 1, wherein the additional structural wire and the first structural wire in the first array of first structural wires provide a beam structure having a total diameter equivalent to a first diameter of the additional structural wire plus a second diameter of the first structural wire plus a third diameter of the one or more structural wires in the second array of second structural wires.

14. A method of improving the stiffness of a screen support frame, said support frame comprising a perimeter disposed in a horizontal plane, defining a vertical direction normal to said plane, a first array of substantially parallel first structural wires extending between opposing regions of the perimeter in a first horizontal plane, a second array of substantially parallel second structural wires extending between opposing regions of the perimeter in a second horizontal plane, said first and second arrays being aligned at an angle with respect to each other and in contact with each other thus forming a plurality of contact points between the first structural wires of the first array and the second structural wires of the second array, the improvement in stiffness being provided by providing at least one additional structural wire, said at least one additional structural wire extends from a first side of the perimeter to a second side of the perimeter located opposite with respect to the first side of the perimeter, said at least one additional structural wire being positioned parallel to, and substantially vertically spaced from, a first structural wire in the first array of first structural wires, and in contact with one or more second structural wires in the second array of second structural wires, thereby providing an arrangement of two parallel wires on either side and in contact with the one or more second structural wires in the second array, said arrangement providing an increased stiffness to the screen support frame.

15. The method according to claim 14, wherein the at least one additional structural wire contacts the first and second sides of the perimeter.

16. A screen support frame comprising, a perimeter disposed in a horizontal plane, defining a vertical direction normal to said plane, said perimeter reinforced by a first arrangement comprising a first array of substantially parallel first structural wires extending between opposing regions of the perimeter in a first horizontal plane, a second array of substantially parallel second structural wires extending between opposing regions of the perimeter in a second horizontal plane, said first array of first structural wires and second array of second structural wires being aligned at an angle with respect to each other and in contact with each other thus forming a plurality of contact points between the first structural wires of the first array and the second structural wires of the second array, the arrangement further comprising at least one additional structural wire having a first end and a second end, said additional structural wire being substantially vertically spaced from a first structural wire in the first array of first structural wires and in contact with one or more structural wires in the second array of second structural wires, wherein at least a substantial portion of the total length of the at least one additional structural wire is parallel with respect to the first structural wire in the first array of first structural wires, and wherein the first and second ends of the at least one additional structural wire contact opposing sides of the perimeter.

* * * * *